US010753217B2

(12) United States Patent
Nishimura et al.

(10) Patent No.: US 10,753,217 B2
(45) Date of Patent: Aug. 25, 2020

(54) AXIAL FLOW ROTATING MACHINE AND DIFFUSER

(71) Applicant: MITSUBISHI HEAVY INDUSTRIES, LTD., Tokyo (JP)

(72) Inventors: Kazuya Nishimura, Tokyo (JP); Eisaku Ito, Tokyo (JP); Koichiro Iida, Tokyo (JP); Kentaro Akimoto, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/379,931

(22) Filed: Apr. 10, 2019

(65) Prior Publication Data

US 2019/0234223 A1 Aug. 1, 2019

Related U.S. Application Data

(62) Division of application No. 14/771,913, filed as application No. PCT/JP2014/057782 on Mar. 20, 2014.

(30) Foreign Application Priority Data

Mar. 29, 2013 (JP) ..... 2013-071075

(51) Int. Cl.
*F01D 9/04* (2006.01)
*F01D 5/14* (2006.01)
(Continued)

(52) U.S. Cl.
CPC ..... *F01D 9/041* (2013.01); *F01D 5/02* (2013.01); *F01D 5/143* (2013.01); *F01D 25/162* (2013.01);
(Continued)

(58) Field of Classification Search
CPC . F01D 9/041; F01D 5/02; F01D 5/143; F01D 25/162; F01D 25/24; F01D 25/30;
(Continued)

(56) References Cited

U.S. PATENT DOCUMENTS 3,625,630 A * 12/1971 Soo ..... F01D 25/30 415/207
2002/0098082 A1 7/2002 Ito et al.
(Continued)

FOREIGN PATENT DOCUMENTS

CN 1116271 2/1996
CN 1172893 2/1998
(Continued)

OTHER PUBLICATIONS

International Search Report dated Jun. 17, 2014 in International Application No. PCT/JP2014/057782.
(Continued)

*Primary Examiner* — Devon C Kramer
*Assistant Examiner* — Kelsey L Stanek
(74) *Attorney, Agent, or Firm* — Wenderoth, Lind & Ponack, L.L.P.

(57) ABSTRACT

An axial flow rotating machine has: a rotor with a plurality of rotor blades; a stator with a plurality of stator blades; an axial flow rotating portion defined by the rotor and the stator; and a diffuser connected to the axial flow rotating portion on a downstream side of the axial flow rotating portion. A final blade portion inner-circumferential inner wall, which is a portion of an inner-circumferential inner wall of the axial flow rotating portion, is defined such that a diameter thereof at a trailing edge position of a final blade is smaller than the diameter at a leading edge position of the final blade. In addition, a diameter of all or a portion of a diffuser inner-
(Continued)

circumferential inner wall decreases in a direction of the downstream side in an axial direction.

8 Claims, 13 Drawing Sheets

(51) Int. Cl.

| | |
|---|---|
| ***F01D 25/16*** | (2006.01) |
| ***F04D 29/54*** | (2006.01) |
| ***F01D 25/30*** | (2006.01) |
| ***F01D 5/02*** | (2006.01) |
| ***F01D 25/24*** | (2006.01) |

(52) U.S. Cl.
CPC ..... *F01D 25/24* (2013.01); *F01D 25/30* (2013.01); *F04D 29/542* (2013.01); *F04D 29/547* (2013.01); *F05D 2220/32* (2013.01); *F05D 2240/12* (2013.01); *F05D 2240/20* (2013.01); *F05D 2250/324* (2013.01)

(58) Field of Classification Search
CPC .. F04D 29/542; F04D 29/547; F05D 2220/32; F05D 2240/12; F05D 2240/20; F05D 2250/324
USPC ..... 415/208.2, 199.1
See application file for complete search history.

(56) References Cited

U.S. PATENT DOCUMENTS

2004/0228726 A1 11/2004 Ishizaka et al.
2007/0025847 A1* 2/2007 Wakazono ..... F01D 25/162 415/208.1
2011/0088379 A1* 4/2011 Nanda ..... F01D 25/30 60/324
2012/0042654 A1* 2/2012 Siden ..... F01D 5/143 60/670
2013/0031913 A1* 2/2013 Little ..... F01D 17/162 60/796
2013/0064647 A1* 3/2013 Hashimoto ..... F01D 25/14 415/116
2013/0081731 A1* 4/2013 Nanda ..... F01D 25/30 138/44
2013/0180246 A1* 7/2013 Nanda ..... F01D 25/30 60/697
2013/0224011 A1* 8/2013 Hashimoto ..... F02C 7/12 415/211.2
2014/0037439 A1 2/2014 Dalsania
2016/0017734 A1* 1/2016 Nishimura ..... F01D 5/143 415/208.2
2017/0342862 A1* 11/2017 Vijayan ..... F02K 1/04

FOREIGN PATENT DOCUMENTS

| | | |
|---|---|---|
| CN | 1550649 | 12/2004 |
| CN | 1987066 | 6/2007 |
| CN | 101010489 | 8/2007 |
| CN | 102373972 | 3/2012 |
| JP | 63-100640 | 6/1988 |
| JP | 8-210152 | 8/1996 |
| JP | 2002-364310 | 12/2002 |
| JP | 2005-290985 | 10/2005 |
| JP | 2011-85134 | 4/2011 |
| JP | 2011-196254 | 10/2011 |
| JP | 2012-41925 | 3/2012 |
| JP | 2012-202242 | 10/2012 |
| JP | 2012-202247 | 10/2012 |
| JP | 2012202247 A * | 10/2012 |

OTHER PUBLICATIONS

Written Opinion of the International Searching Authority dated Jun. 17, 2014 in International Application No. PCT/JP2014/057782.
Office Action dated Jan. 27, 2016 in Chinese Application No. 201480011302.7 (with English Translation).
Notice of Reasons for Rejection dated Jun. 28, 2016 in Japanese Application No. 2013-071075 (with English Translation).
Second Office Action dated Oct. 8, 2016 in Chinese Application No. 201480011302.7 (with English Translation).

* cited by examiner

AXIAL FLOW ROTATING MACHINE AND DIFFUSER

CROSS-REFERENCE TO RELATED APPLICATION

This application claims priority to Japanese Patent Application No. 2013-071075 filed on Mar. 29, 2013, the content of which is hereby incorporated herein by reference.

TECHNICAL FIELD

The present invention relates to an axial flow rotating machine and a diffuser that are applied to a gas turbine, and the like.

BACKGROUND ART

In a gas turbine, a diffuser is installed, which is connected to an axial flow rotating machine, such as a compressor or a turbine, on the downstream side of the axial flow rotating machine. Deceleration and pressure (static pressure) recovery of working fluid, such as compressed air or combustion gas, is performed by the diffuser (refer to Japanese Unexamined Patent Application Publication No. 2005-290985A and Japanese Unexamined Patent Application Publication No. H08-210152A, for example).

In a gas turbine 102 illustrated in FIG. 12, a diffuser 101, which is connected to a turbine on the downstream side of the turbine, is formed by concentrically arranging an inner-circumferential inner wall 108 with an outer-circumferential inner wall 109 that is formed with the diameter thereof increasing in the direction of the downstream side. A circular flow path 110 is formed between the inner-circumferential inner wall 108 and the outer-circumferential inner wall 109. A gas turbine 2 is provided with a turbine casing 3 on the outer side thereof. Sets of a stator blade 5 and a rotor blade 6 are arranged in a plurality of stages inside the turbine casing 3.

A rear end of a rotor 20, to which a final-stage rotor blade **6*f* is attached, is supported by a bearing 12. A bearing housing 11 that houses the bearing 12 is concentrically supported with the center of the turbine casing 3 by a plurality of struts 14 that are radially arranged so as to traverse the flow of the working fluid. The struts 14 are covered by a strut cover 15 so as to inhibit the struts 14 from being exposed to high-temperature exhaust gas. Furthermore, downstream of the struts 14, a cylindrical manhole 16** is provided which are radially arranged so as to traverse the flow of working fluid.

Next, a diffuser that is connected to a compressor on the downstream side of the compressor will be described with reference to FIG. 13. A turbine 102B includes a compressor 50, a combustor 51 to which compressed air generated in the compressor 50 is supplied, and a turbine 52. The compressor 50 has a structure in which sets of a stator blade 5B and a rotor blade 6B are arranged in a plurality of stages.

A diffuser 101B, which is connected to the compressor 50 on the downstream side of the compressor 50, is formed by concentrically arranging an inner-circumferential inner wall 108B, which has the diameter thereof decreasing in the direction of the downstream side from a position downstream of a final blade 7, with an outer-circumferential inner wall 109B, which has the diameter thereof increased in the direction of the downstream side from the position.

The final blade 7 is a blade that is located furthest downstream among the plurality of stator blades 5B and the plurality of rotor blades 6B. When an OGV, namely, an outlet guide blade is located downstream of the stator blades 5B and the rotor blades 6B, the OGV becomes the final blade 7. A circular flow path 110B is formed between the inner-circumferential inner wall 108B and the outer-circumferential inner wall 109B.

Technical Problem

With reference to FIG. 12 and FIG. 13, the diffusers 101 and 101B can cause the flow rate to decrease further as a ratio between the areas of inlet portions of the circular flow paths 110 and 110B and the areas of outlet portions thereof is larger. Thus, from a perspective of improving performance, it is preferable to decrease the diameters of the inner-circumferential inner walls 108 and 108B in the direction of the downstream side in the circular flow paths 110 and 110B.

Here, when the inner-circumferential inner walls 108 and 108B are shaped so that the diameters thereof are decreased in the direction of the downstream side, there is a possibility that the flow of the working fluid becomes separated from wall surfaces of the inner-circumferential inner walls 108 and 108B. The separation of the flow causes energy loss, and thus, the performance of the diffuser deteriorates.

SUMMARY OF INVENTION

An object of the present invention is to provide an axial flow rotating machine and a diffuser that are capable of improving performance thereof by expanding a cross-sectional area of a circular flow path without causing the flow of working fluid to be separated.

Solution To Problem

According to a first aspect of the present invention, an axial flow rotating machine includes: a rotor that is provided with a plurality of rotor blades and that freely rotates around an axial line; a stator that is provided with a plurality of stator blades arranged adjacent to the plurality of rotor blades; an axial flow rotating portion that is formed by the rotor and the stator; and a diffuser that is connected to the axial flow rotating portion on the downstream side of the axial flow rotating portion and that extends in the axial direction to form a circular flow path. In such an axial flow rotating machine, a final blade portion inner-circumferential inner wall, which is a portion of an inner-circumferential inner wall of the axial flow rotating portion corresponding to an axial-direction position of a final blade, is formed so that the diameter at a trailing edge position of the final blade is smaller than the diameter at a leading edge position of the final blade, the final blade being a blade located furthest downstream among the plurality of rotor blades and the plurality of stator blades. The diameter of all or a portion of a diffuser inner-circumferential inner wall, which is an inner-circumferential inner wall of the diffuser, decreases in the direction of a first side in the axial direction, the first side being the downstream side.

According to the above-described structure, as the diameter of the inner-circumferential inner wall starts decreasing from the upstream side of the inlet of the diffuser, it is possible to attain a smooth diffuser effect from the upstream side of the inlet. Furthermore, it is possible to form all or a portion of the inner-circumferential inner wall of the diffuser with a gentle inclination, and thus, it is possible to reduce the separation.

The above-described axial flow rotating machine may be structured so that the diameter of the diffuser inner-circumferential inner wall starts decreasing from an end portion on the downstream side of the final blade portion inner-circumferential inner wall.

According to the above-described structure, the upstream final blade portion inner-circumferential inner wall and the downstream inner-circumferential inner wall are connected while being in an inclined manner. Thus, it is possible to realize a smooth flow from the upstream side.

In the above-described axial flow rotating machine, an inclination angle of the diffuser inner-circumferential inner wall may be equal to or greater than an average inclination angle from a leading edge to a trailing edge of the final blade on the final blade portion inner-circumferential inner wall and be less than 0 degrees.

According to the above-described structure, in the axial flow rotating portion, the working fluid has a swirling flow component and the inertia force is applied in the radial direction, and thus even if the inclination is sharp, the separation is unlikely to occur. However, inside the diffuser, in which the swirling component does not exist (or is small), the separation is suppressed by making the inclination gentle.

In the above-described axial flow rotating machine, the diffuser is connected to a final-stage rotor blade of a turbine on the downstream side of the final-stage rotor blade, the final blade portion inner-circumferential inner wall is a final-stage rotor blade inner-circumferential inner wall, and the diameter of the final-stage rotor blade inner-circumferential inner wall starts decreasing from a position between a leading edge of the final-stage rotor blade and a throat position.

According to the above-described structure, as a width of a flow path decreases from the leading edge of the final-stage rotor blade to the throat position, it is possible to start decreasing the diameter of the inner-circumferential inner wall from a position between the leading edge and the throat position, without causing the separation to occur.

According to a second aspect of the present invention, a diffuser is connected to a final-stage rotor blade of a turbine on the downstream side of the final-stage rotor blade. The diffuser includes: an outer-circumferential inner wall that is provided on an outer circumferential side of an inner-circumferential inner wall of the diffuser so that the outer-circumferential inner wall is separated from the inner-circumferential inner wall, and that defines a circular flow path between the outer-circumferential inner wall and the inner-circumferential inner wall; and a connecting member that connects the inner-circumferential inner wall and the outer-circumferential inner wall in the radial direction inside the circular flow path and that has a blade-like cross-sectional shape. The diameter of the inner-circumferential inner wall decreases in the direction of a first side in the axial direction, the first side being the downstream side, and the decrease of the diameter reaches a connecting member inner-circumferential inner wall, which is an inner-circumferential inner wall corresponding to an axial-direction position of the connecting member. The connecting member inner-circumferential inner wall is formed by a first inclination portion located upstream of the connecting member inner-circumferential inner wall, and a second inclination portion located downstream of the first inclination portion. The first inclination portion and the second inclination portion are connected with each other at a position located downstream of a throat position of the connecting member and upstream of the trailing edge that includes a trailing edge position of the connecting member, and an inclination angle of the second inclination portion is equal to or greater than an inclination angle of the first inclination portion and is less than 0 degrees.

According to the above-described structure, the width of the flow path increases from the throat position to the trailing edge of the connecting member, and it is thus possible to inhibit the separation from occurring by reducing the inclination caused by the decrease in the diameter.

According to a third aspect of the present invention, a diffuser is connected to a final-stage rotor blade of a turbine on the downstream side of the final-stage rotor blade. The diffuser includes: an inner-circumferential inner wall that has a cylindrical shape extending in the axial direction; an outer-circumferential inner wall that is provided on an outer circumferential side of the inner-circumferential inner wall so that the outer-circumferential inner wall is separated from the inner-circumferential inner wall, and that defines a circular flow path between the outer-circumferential inner wall and the inner-circumferential inner wall; and a connecting member that connects the inner-circumferential inner wall and the outer-circumferential inner wall in the radial direction inside the circular flow path. In such a diffuser, the diameter of at least a portion of the inner-circumferential inner wall in the axial direction decreases in the direction of a first side in the axial direction, the first side being the downstream side of the circular flow path, and at least one of a leading edge and a trailing edge of the connecting member is inclined toward a second side in the axial direction, as the edge extends from the outer-circumferential inner wall to the inner-circumferential inner wall, the second side being the upstream side of the circular flow path.

According to the above-described structure, as the connecting member is inclined and the diameter of the inner-circumferential inner wall decreases in the direction of the first side in the axial direction, it is possible to expand a cross-sectional area of the circular flow path without causing the flow of working fluid to be separated. In this manner, it is possible to improve the performance of an exhaust diffuser.

According to a fourth aspect of the present invention, a diffuser is connected to a final blade on the downstream side of the final blade that is a blade located furthest downstream among a plurality of rotor blades and a plurality of stator blades of the axial flow rotating machine provided with a rotor that is provided with the plurality of rotor blades and that freely rotates around an axial line, and a stator that is provided with the plurality of stator blades arranged adjacent to the plurality of rotor blades. The diffuser includes: an inner-circumferential inner wall that has a cylindrical shape extending in the axial direction; and an outer-circumferential inner wall that is provided on an outer circumferential side of the inner-circumferential inner wall so that the outer-circumferential inner wall is separated from the inner-circumferential inner wall, and that defines a circular flow path between the outer-circumferential inner wall and the inner-circumferential inner wall. In such a diffuser, the diameter of the inner-circumferential inner wall decreases over the entire section of the inner-circumferential inner wall in the axial direction in the direction of a first side in the axial direction, the first side being the downstream side of the circular flow path, and a base end portion of the final blade is formed so that a total pressure of working fluid at an outlet of the final blade becomes high compared with a total pressure in a central portion of the final blade in the blade-height direction.

According to the above-described structure, by employing the structure in which the diameter of the inner-circumferential inner wall decreases over the entire section in the axial direction, it is possible to cause the angle of the inner-circumferential inner wall to be more gentle, and it is thus possible to further inhibit the separation of the flow.

Advantageous Effects of Invention

According to the present invention, as the diameter of the inner-circumferential inner wall decreases from the upstream side of the inlet of the diffuser, a smooth diffuser effect from the upstream side of the inlet can be attained, and thus, it is possible to cause the inclination of a portion or all of the inner-circumferential inner wall of the diffuser to be gentle, to inhibit the separation.

DESCRIPTION OF EMBODIMENTS

First Embodiment

A first embodiment of the present invention will be described below in detail with reference to the attached drawings.

Figure 1:
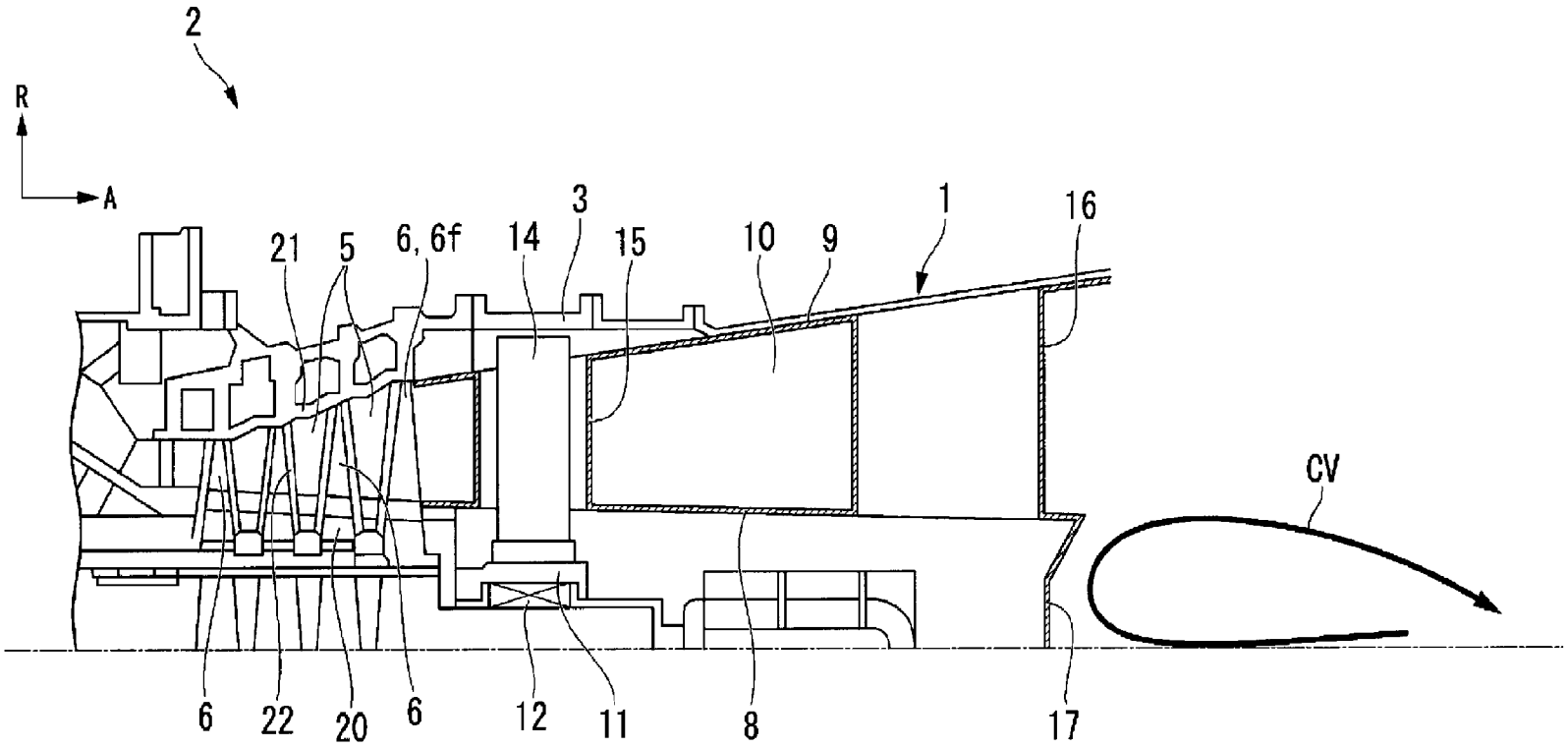
FIG. 1 is a cross-sectional view illustrating a section around an exhaust diffuser of a gas turbine according to a first embodiment of the present invention.

As illustrated in FIG. 1, a gas turbine 2 including a diffuser 1 according to the present embodiment has a turbine casing 3 provided on the outer side thereof, and has sets of a stator blade 5 fixed to a stator 21 and a rotor blade 6 fixed to a rotor 20 arranged in a plurality of stages therein. An axial flow rotating portion 22 is formed by the rotor 20 and the stator 21. The diffuser 1 is connected to the axial flow rotating portion 22 on the downstream side of the axial flow rotating portion 22.

In the gas turbine 2, after the turbine is started up, a working fluid, such as combustion gas, passes through the diffuser 1, which is provided downstream with respect to the flow of the fluid, and is then sent out to the next device, and the like. A reference sign A in the diagrams indicates a flow direction of the fluid, and a reference sign R indicates a radial direction of the rotor 20 of the gas turbine 2.

The diffuser 1 is formed by concentrically arranging a diffuser inner-circumferential inner wall 8 (a hub-side tube), which is an inner wall on the inner-circumferential side of the diffuser 1 and forms a cylindrical shape extending in the axial direction, with an outer-circumferential inner wall 9 (a tip-side tube), which is provided on the outer-circumferential side of the diffuser inner-circumferential inner wall 8 so as to be separated from the diffuser inner-circumferential inner wall 8. A circular flow path 10 is provided between the diffuser inner-circumferential inner wall 8 and the outer-circumferential inner wall 9. A rear end of the rotor 20, to which the rotor blade 6 is attached, is supported by a bearing 12 (a journal bearing) that is housed in a bearing housing 11. The bearing housing 11 is concentrically supported with the center of the turbine casing 3 by a plurality of struts 14 that are radially arranged so as to traverse the flow of the working fluid.

The strut 14 is covered by a strut cover 15 (a connecting member, a first connecting member) so as to inhibit the strut 14 from being exposed to high-temperature exhaust gas. Furthermore, downstream of the strut 14, a cylindrical manhole 16 (a connecting member, a second connecting member) is provided, radially arranged so as to traverse the flow of working fluid in the same manner as the strut 14. A base surface 17 is provided at the downstream end of the diffuser inner-circumferential inner wall 8. A circulating flow CV is formed downstream of the base surface 17.

The strut cover 15 is formed in an elliptical shape or a blade shape extending along the flow direction of the fluid, so as to reduce aerodynamic loss. The manhole 16 is a cylindrical member that functions as a passageway that enables a person to enter into the bearing 12 of the gas turbine 2, for example. The manhole 16 is formed in an elliptical shape or a blade shape extending along the flow direction of the fluid.

The diffuser inner-circumferential inner wall 8 of the present embodiment has a shape in which the diameter thereof decreases in the direction of a first side in the axial direction (the right side in FIG. 1), the first side being on the downstream side of the circular flow path 10. More specifically, the diffuser inner-circumferential inner wall 8 has a cylindrical shape in which the center axis thereof extends along the axial direction and the diameter thereof gradually decreases as it extends through the first side in the axial direction from a second side, which is an opposite side to the first side in the axial direction. In other words, the diffuser inner-circumferential inner wall 8 is inclined toward an open side so that the circular flow path 10 expands. As a result, the circulating flow CV becomes small, and thereby, the performance of the diffuser 1 is improved.

Furthermore, the outer-circumferential inner wall 9 has a shape in which the diameter thereof increases in the direction of the downstream side of the circular flow path 10.

Figure 2:
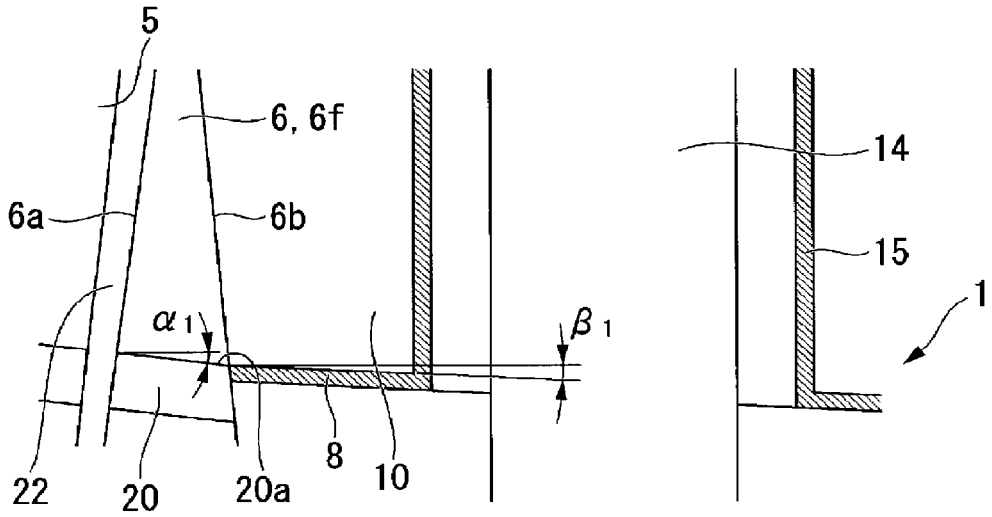
FIG. 2 is a partial enlarged view of FIG. 1.

As illustrated in FIG. 2, of the inner-circumferential inner wall of the rotor 20 to which the final-stage rotor blade **6*f* is fixed upstream of an inlet of the diffuser 1, the outer diameter of a final blade portion inner-circumferential inner wall 20*a* that corresponds to a position of the final-stage rotor blade 6*f* in the axial direction is formed so that the outer diameter at a trailing edge position 6*b* of the final-stage rotor blade 6***f* is smaller than the outer diameter at a leading edge position 6*a* of the final-stage rotor blade 6*f*. In other words, of the inner-circumferential inner wall of the rotor 20, the final blade portion inner-circumferential inner wall 20*a* is the inner-circumferential inner wall that is formed within a range in the axial direction in which the final-stage rotor blade 6*f* is present. Here, the inner-circumferential inner wall of the rotor 20 is an inner wall on the inner-circumferential side of the circular flow path that is formed by the rotor 20 and the stator 21.

An average inclination angle α1 from the leading edge position 6*a* to the trailing edge position 6*b* is from −20 degrees to −2 degrees, and preferably, from −15 degrees to −5 degrees. In FIG. 2, the final blade portion inner-circumferential inner wall 20*a* of the rotor 20 having a uniform inclination angle α1 is illustrated.

The decrease of the diameter of the diffuser inner-circumferential inner wall 8 starts from an inlet position of the diffuser 1, namely, from a connecting portion with the rotor 20. An average inclination angle β1 from the inlet position of the diffuser 1 to an outlet position thereof is preferably equal to or greater than the average inclination angle α1 of the final blade portion inner-circumferential inner wall 20*a* and less than 0 degrees. In FIG. 1 and FIG. 2, the diffuser inner-circumferential inner wall 8 having a uniform inclination angle β1 is illustrated.

According to the above-described embodiment, as the diameter of the diffuser inner-circumferential inner wall 8 continuously decreases from the upstream side of the inlet of the diffuser 1 via the inlet of the diffuser 1, it is possible to attain a smooth diffuser effect from the upstream side of the inlet. Furthermore, it is possible to form a portion of all of the diffuser inner-circumferential inner wall 8 with a gentle inclination, and thereby, the separation can be reduced. Furthermore, by making the cross-sectional area of the diffuser enlarged before reaching the struts 14, the flow rate before the struts 14 is suppressed, and thereby, the performance of the diffuser is improved.

Furthermore, the average inclination angle β1 from the inlet position of the diffuser 1 to the outlet position thereof is set so as to be equal to or greater than the average inclination angle α1 of the final blade portion inner-circumferential inner wall 20*a* and less than 0 degrees. Inside the turbine, as the working fluid has a swirling flow component and the inertia force is applied in the radial direction, the inclination caused by the decrease of the diameter becomes gentle in the diffuser where the swirling component does not exist (or is reduced). As a result, a separation inhibiting effect is accelerated.

Furthermore, as a result of the outer-circumferential inner wall 9 having the shape in which the diameter thereof increases in the direction of the downstream side, it is possible to reduce an amount of the diameter decrease of the diffuser inner-circumferential inner wall 8 and also to accelerate the separation inhibiting effect.

Figure 13:
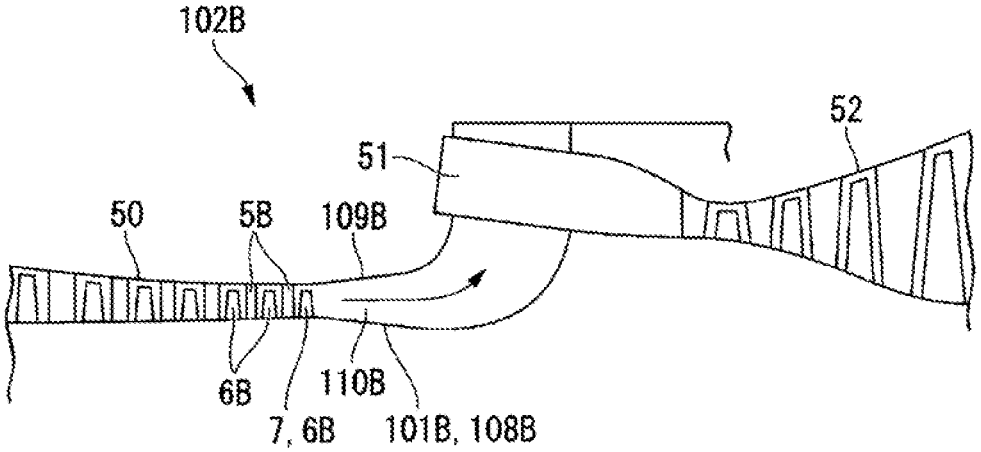
FIG. 13 PRIOR ART
FIG. 13 is a cross-sectional view illustrating a conventional gas turbine.

Note that the shape of the diffuser of the present embodiment can be applied not only to the turbine, but also to a diffuser as illustrated in FIG. 13, which is connected to a compressor on the downstream side of the compressor. More specifically, the shape of the diffuser of the present embodiment can be applied to a diffuser that is connected to an axial flow rotating machine on the downstream side of the axial flow rotating machine that includes a rotor that is provided with a plurality of rotor blades and that freely rotates around the axial line, and a stator that is provided with a plurality of stator blades arranged between the plurality of rotor blades.

Note that, when the shape of the diffuser of the present embodiment is applied to the diffuser of the compressor, the final-stage rotor blade 6*f* of the above-described embodiment is a final-stage stator blade of the compressor. However, when an outlet guide blade (OGV) is located downstream of the final-stage stator blade, the outlet guide blade becomes a blade corresponding to the final-stage rotor blade 6*f* of the above-described embodiment.

Second Embodiment

A second embodiment of the diffuser 1 of the present invention will be described below with reference to the attached drawings. Note that, in the present embodiment, points that are different from the above-described first embodiment will be mainly described, and a description will be omitted of the portions that are the same.

Figure 3:
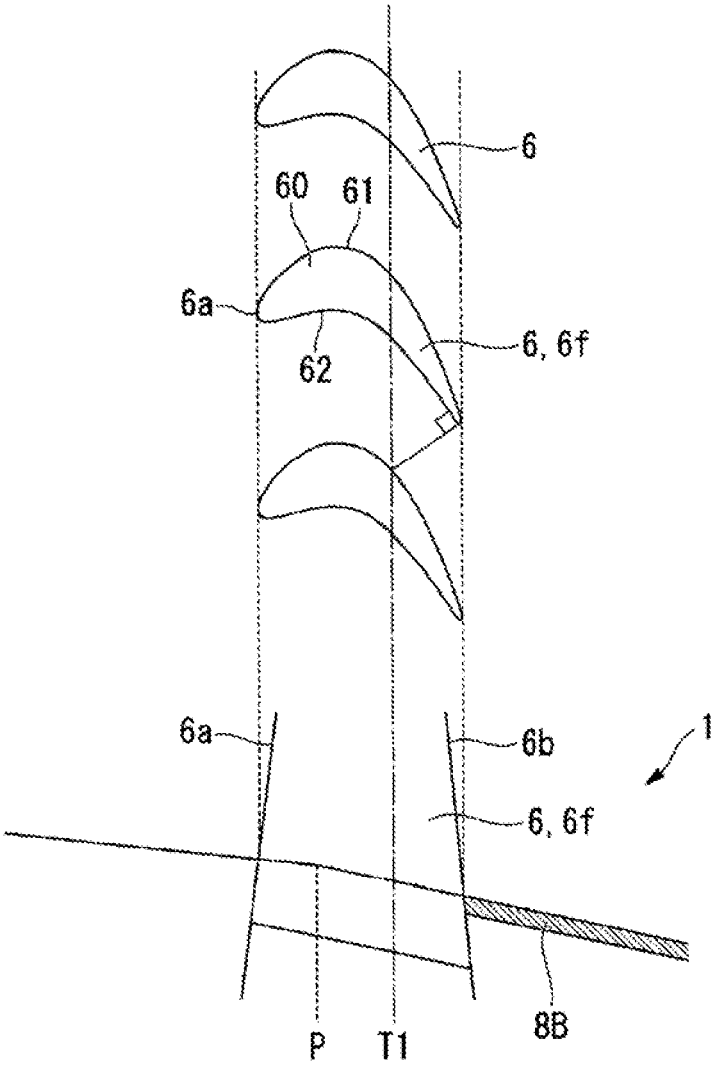
FIG. 3 is a partial enlarged view of an exhaust diffuser of a gas turbine according to a second embodiment of the present invention.

As illustrated in FIG. 3, the decrease of the diameter of the diffuser 1 of the present embodiment is characterized by starting from a position P located between the leading edge 6*a* of the final-stage rotor blade 6*f* and a throat position T.

Here, the throat position T will be described. As illustrated in a profile of the final-stage rotor blade 6*f*, the profile being illustrated in an upper section of FIG. 3, the final-stage rotor blade 6*f* is provided with a main body portion 60 having a suction side 61 and a pressure side 62, with the leading edge 6*a* and the trailing edge 6*b* connecting the suction side 61 and the pressure side 62. A throat position T1 is a position at which the width of the flow path between the plurality of final-stage rotor blades 6*f* arranged at regular intervals becomes the narrowest.

According to the above-described embodiment, as the width of the flow path decreases from the leading edge 6*a* of the final-stage rotor blade 6*f* to the throat position T1, it is possible to start decreasing the diameter of an inner-circumferential inner wall 8B from the position P located between the leading edge 6*a* and the throat position T, without causing the separation to occur.

Third Embodiment

A third embodiment of the diffuser 1 of the present invention will be described below with reference to the attached drawings. Note that, in the present embodiment, points that are different from the above-described first embodiment will be mainly described, and a description will be omitted of the portions that are the same.

Figure 4:
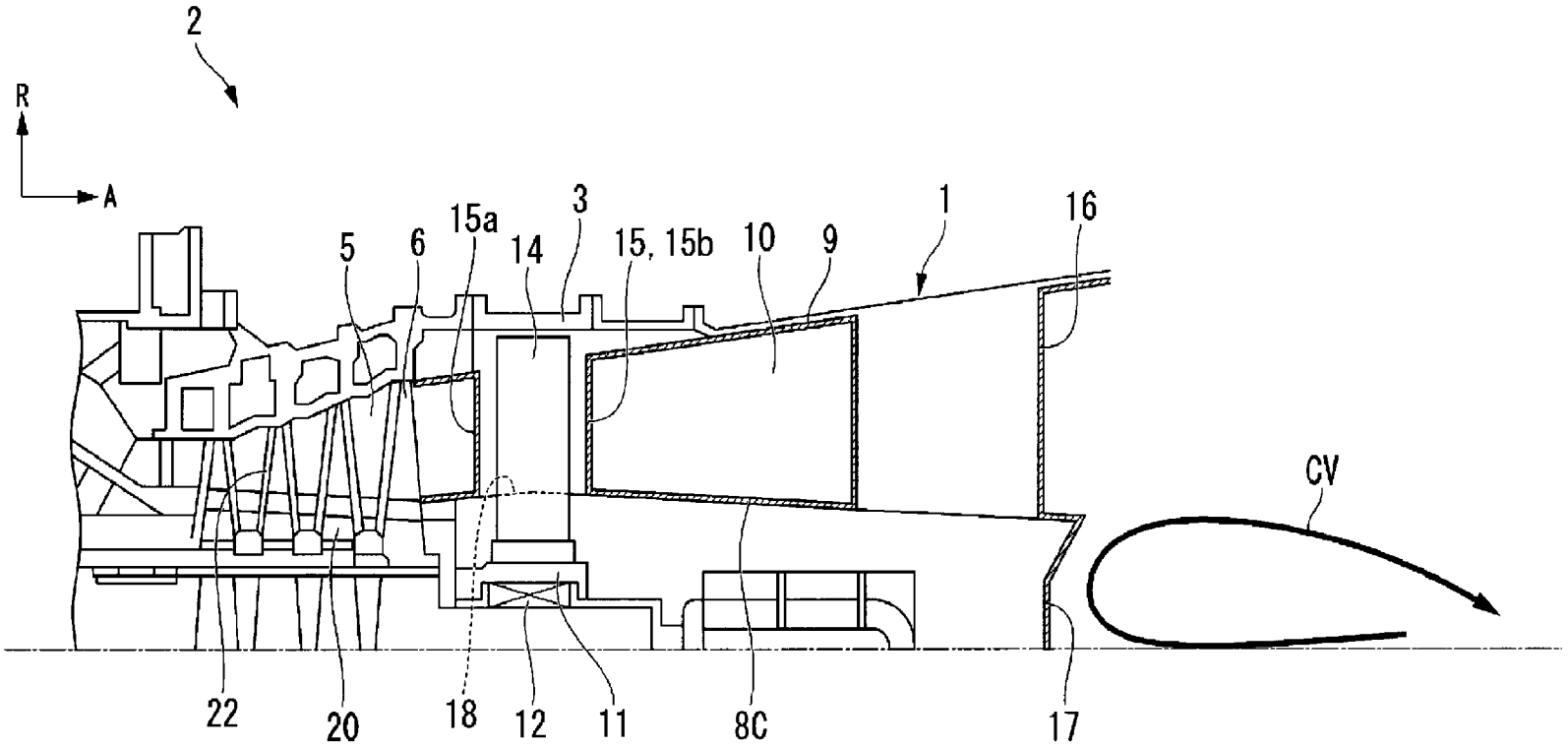
FIG. 4 is a cross-sectional view illustrating a section around an exhaust diffuser of a gas turbine according to a third embodiment of the present invention.

As illustrated in FIG. 4, the decrease of the diameter of an inner-circumferential inner wall 8C of the diffuser 1 of the present embodiment reaches a connecting member inner-circumferential inner wall 18 that is an inner-circumferential inner wall corresponding to an axial-direction position of the strut cover 15 (connecting member). The decrease of the diameter of the inner-circumferential inner wall 8C of the diffuser 1 of the present embodiment starts in a section between a throat position T2 (refer to FIG. 5 and FIG. 6) of the strut cover 15 and a trailing edge position 15*b* in the axial direction. In other words, a diameter decrease starting position P1 (refer to FIG. 6) is located between the throat position T2 of the strut cover 15 and the trailing edge position 15*b* in the axial direction. Note that, when the decrease of the diameter starts from upstream of the diameter decrease starting position P1, the diameter decrease starting position P1 becomes a position from which a further decrease of the diameter starts.

Figure 5:
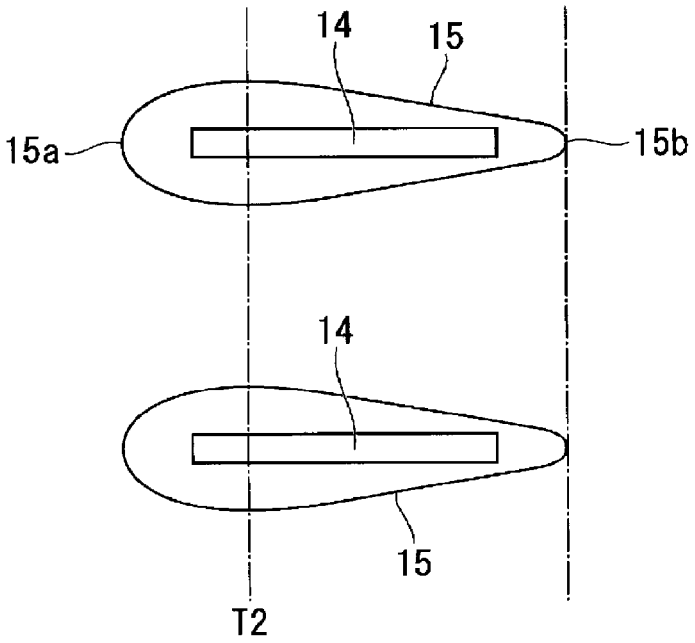
FIG. 5 is a diagram illustrating a cross-sectional shape of struts, as viewed from the radial direction.

FIG. 5 is a diagram illustrating a cross-sectional shape of the strut covers 15, as viewed from the radial direction. As illustrated in FIG. 5, the throat position T2 is a position at which a width of a flow path between the strut covers 15, which have a blade-like cross-section and are arranged at intervals in the circumferential direction, becomes the narrowest.

Figure 6:
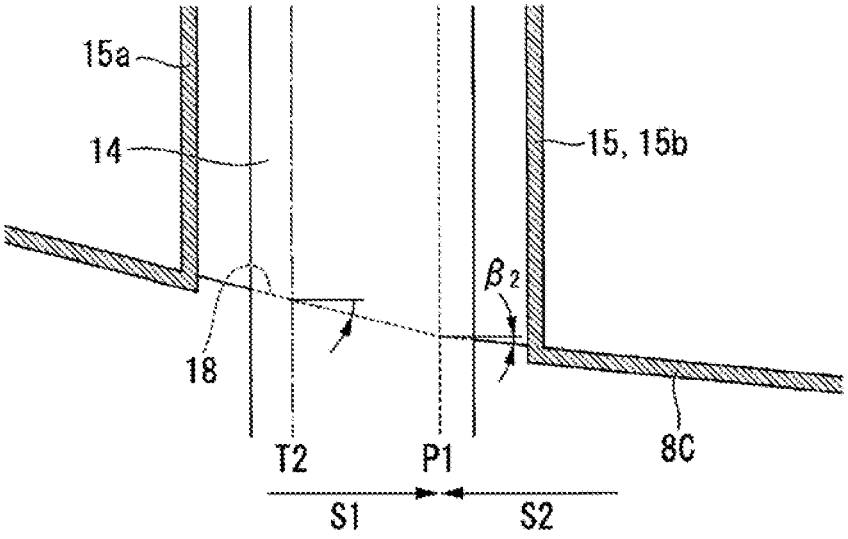
FIG. 6 is a partial enlarged view of FIG. 4.

As illustrated in FIG. 6, the connecting member inner-circumferential inner wall 18 is formed by a first inclination portion S1 located upstream of the diameter decrease starting position P1 and a second inclination portion S2 located downstream of the first inclination portion S1.

Then, an inclination angle β2 of the second inclination portion S2 is formed so as to be equal to or greater than an inclination angle α1 and less than 0 degrees. More specifically, the decrease of the diameter, which starts from the diameter decrease starting position P1, preferably becomes gentle downstream of the position P1.

According to the above-described embodiment, as the width of the flow path is increased from the throat position T2 to a trailing edge 15*b* of the strut cover 15, it is possible to inhibit the separation from occurring by decreasing the inclination caused by the decrease of the diameter.

Note that, although, in the above-described embodiment, an example has been illustrated in which the decrease of the diameter of the connecting member inner-circumferential inner wall 18 starts from a position between the throat position T2 of the strut cover 15 and the trailing edge 15*b*, the present invention is not limited to this example. For example, it may be structured so that the decrease of the diameter of the inner-circumferential inner wall starts from a position between the manhole 16, which is another connecting member connecting the inner-circumferential inner wall and the outer-circumferential inner wall, and the trailing edge.

Fourth Embodiment

A fourth embodiment of the present invention will be described below in detail with reference to the attached drawings.

Figure 7:
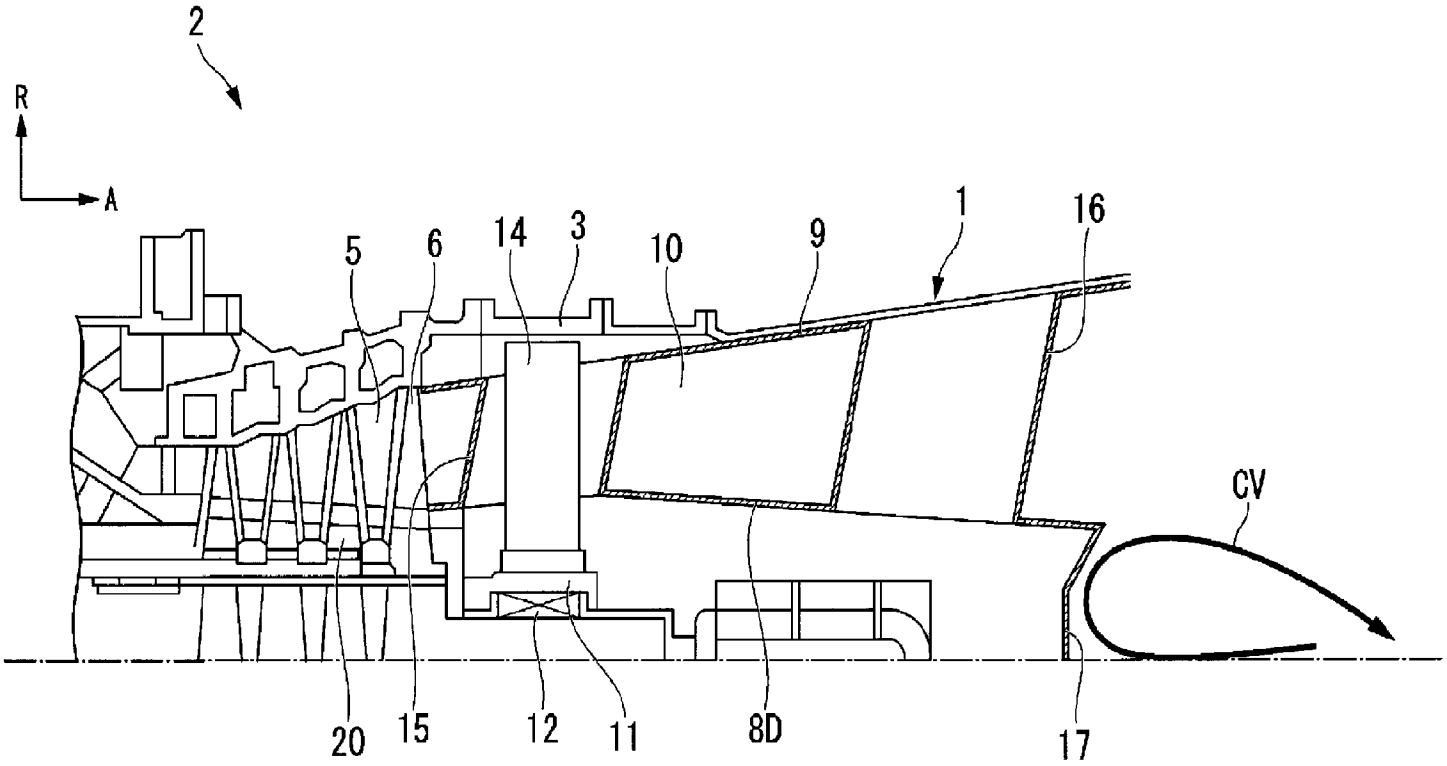
FIG. 7 is a cross-sectional view illustrating a section around an exhaust diffuser of a gas turbine according to a fourth embodiment of the present invention.

As illustrated in FIG. 7, the diffuser 1 of the present embodiment is characterized in that the strut cover 15 (connecting member) and the manhole 16 (connecting member) are inclined toward the second side in the axial direction as they extend from the outer-circumferential inner wall 9 to an inner-circumferential inner wall 8D, the second side being the upstream side of the circular flow path 10.

Figure 8:
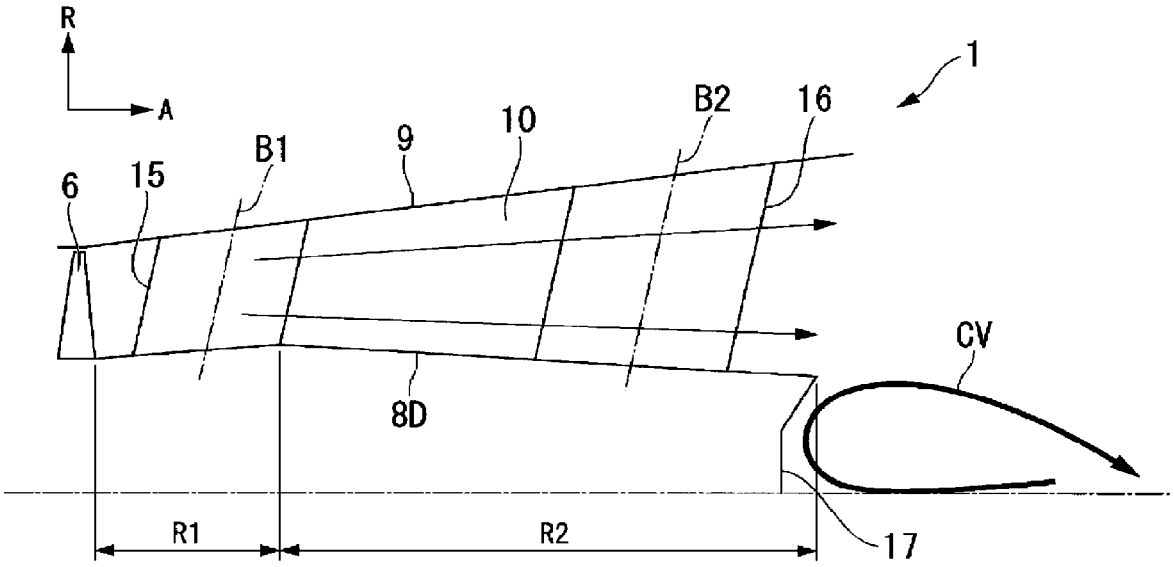
FIG. 8 is a schematic view illustrating an exhaust diffuser according to the fourth embodiment of the present invention.

As illustrated in FIG. 7 and FIG. 8, the inner-circumferential inner wall 8D of the diffuser 1 of the present embodiment has a shape in which the diameter thereof decreases in the direction of the first side in the axial direction (the right side in FIG. 7 and FIG. 8), the first side being the downstream side of the circular flow path 10. More specifically, the inner-circumferential inner wall 8D has a cylindrical shape in which the center axis thereof extends along the axial direction and the diameter thereof gradually decreases in the direction from the second side in the axial direction to the first side in the axial direction. As a result, the inner-circumferential inner wall 8D is inclined so that the circular flow path 10 expands.

Furthermore, the strut cover 15 and the manhole 16 of the present embodiment form a shape (also referred to as a Sweep shape) that is inclined toward the second side in the axial direction as they extend from the outer-circumferential inner wall 9 to the inner-circumferential inner wall 8D, the second side being the upstream side of the circular flow path 10. In other words, respective center axes B1 and B2 of the strut cover 15 and the manhole 16 are inclined toward the first side in the axial direction as they extend from the inner circumferential side to the outer circumferential side of the rotor 20 in the radial direction R, and outer circumferential surfaces of the strut cover 15 and the manhole 16 are shaped along the center axes.

The decrease of the diameter of the inner-circumferential inner wall 8D starts from a connecting portion between the strut cover 15 and the inner-circumferential inner wall 8D. A range over which the diameter of the inner-circumferential inner wall 8D decreases is denoted by R2. Meanwhile, up to the connecting portion between the strut cover 15 and the inner-circumferential inner wall 8D, the inner-circumferential inner wall 8D has a shape in which the diameter thereof increases in the direction of the first side in the axial direction. A range over which the diameter of the inner-circumferential inner wall 8D increases is denoted by R1.

Note that the shape in the range R1 may be a cylindrical shape having an outer circumferential surface parallel with the axial direction without having an increasing diameter. More specifically, it is sufficient that the diameter does not decrease in the direction of the first side in the axial direction.

According to the above-described embodiment, the flow rate of the working fluid flowing in from upstream is decreased by the circular flow path 10 having a gradually increasing diameter. Here, in the present embodiment, as a result of the strut cover 15 and the manhole 16 being inclined, it is possible to inhibit the flow of the working fluid from being separated. More specifically, as a result of the diameter of the inner-circumferential inner wall 8D being decreased, the flow of the working fluid that is likely to be separated is pushed down due to the inclination of the strut cover 15 and the manhole 16, and thus, the separation is inhibited. Accordingly, it is possible to improve the performance of the diffuser 1.

Furthermore, as a plurality of inclined members are provided, the separation inhibiting effect on the flow of the working fluid is further improved.

Note that an effect attained by the Sweep shape of the strut 14 and the manhole 16 has been validated by computational fluid dynamics (CFD) analysis. More specifically, it has been validated that, as a result of the strut 14 and the manhole 16 being formed in the Sweep shape, the flow of the fluid is shifted to the inner-circumferential inner wall 8D side, and thus, the separation of the fluid is inhibited.

Furthermore, as a result of the inner-circumferential inner wall 8D being inclined, it is possible to make the circulating flow CV small. By making the circulating flow CV small, it is also possible to improve the performance of the diffuser 1.

Note that, although, in the above-described embodiment, a structure is illustrated in which the diameter of the inner-circumferential inner wall 8D decreases over the entire section on the first side in the axial direction of the connecting portion, the present invention is not limited to this example and may have a shape in which the diameter of at least portion of the inner-circumferential inner wall 8D decreases.

Figure 9:
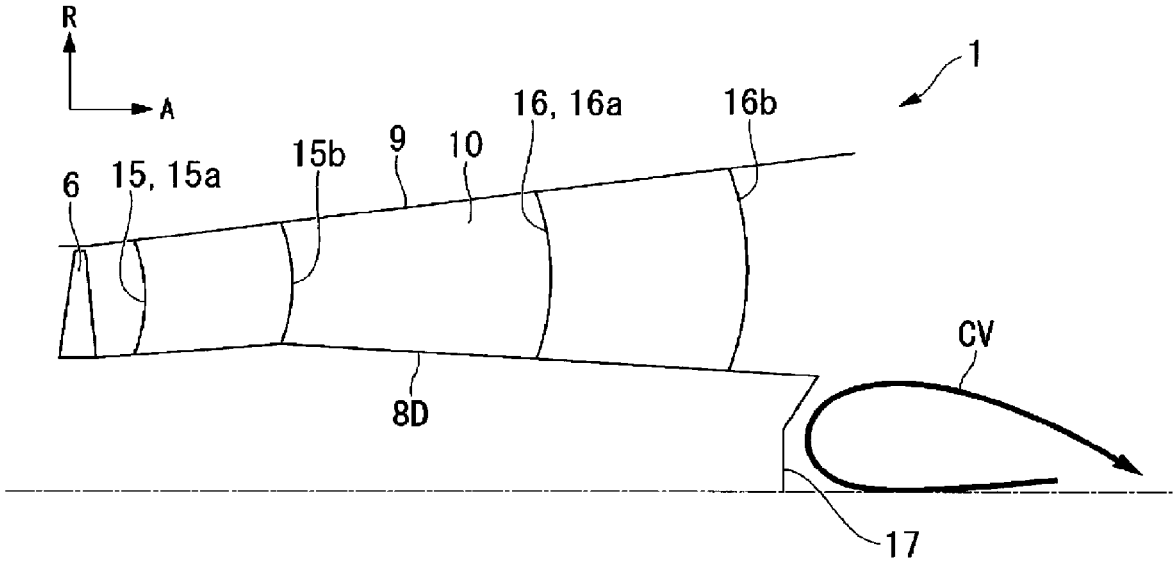
FIG. 9 is a schematic view illustrating an exhaust diffuser according to a modified example of the fourth embodiment of the present invention.

Furthermore, in the above-described embodiment, all of the leading edges and the trailing edges of the strut covers 15 and the manholes 16 are formed in the Sweep shape. Whereas, as in a modified example illustrated in FIG. 9, the strut covers 15 and the manholes 16 may have a shape in which only some of leading edges 15*a* and 16*a* and trailing edges 15*b* and 16*b* (particularly those on the inner-circumferential inner wall 8D side) are inclined. Furthermore, portions that are formed in the Sweep shape may be only the leading edges 15*a* and 16*a*, or may be only the trailing edges 15*b* and 16*b*.

Furthermore, although, in the above-described embodiment, an example is illustrated in which both of the strut cover 15 and the manhole 16 are inclined, the present invention is not limited to this example, and it may be structured so that one of the strut cover 15 and the manhole 16 is inclined. However, when the manhole 16 has an inclined shape, the inner-circumferential inner wall 8D located on the second side in the axial direction of the manhole 16 should not have a shape in which the diameter thereof decreases in the direction of the first side in the axial direction. More specifically, the inner-circumferential inner wall 8D should not have a shape in which the diameter thereof decreases over a section in which an effect of pushing back the fluid that is likely to be separated from the inner-circumferential inner wall 8D due to the decrease of the diameter of the inner-circumferential inner wall 8D in the direction of the inner-circumferential inner wall 8D side is not exhibited.

Fifth Embodiment

A fifth embodiment of the diffuser 1 of the present invention will be described below with reference to the attached drawings. Note that, in the present embodiment, points that are different from the above-described fourth embodiment will be mainly described, and a description will be omitted of the portions that are the same.

Figure 10:
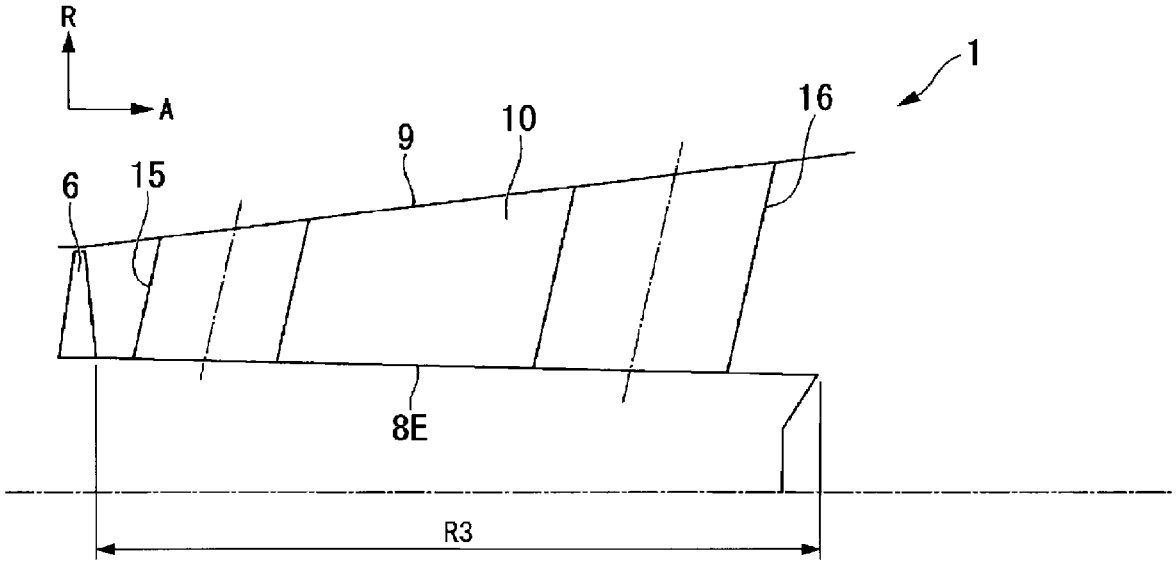
FIG. 10 is a schematic view illustrating an exhaust diffuser according to a fifth embodiment of the present invention.

As illustrated in FIG. 10, an inner-circumferential inner wall 8E of the present embodiment has a shape in which the diameter thereof decreases over the entire section in the axial direction. A range over which the diameter of the inner-circumferential inner wall 8D decreases is denoted by R3. The decrease of the diameter of the inner-circumferential inner wall 8E starts immediately from a final-stage rotor blade 6 in the direction of the downstream side. More specifically, the inner-circumferential inner wall 8E forms a shape so that the decrease of the diameter already starts from upstream of the strut cover 15.

Figure 11:
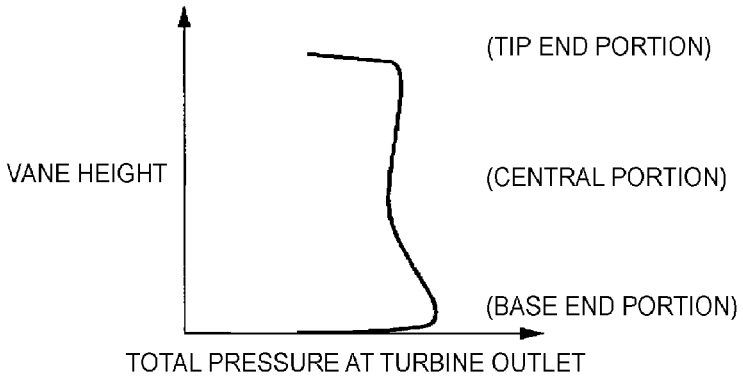
FIG. 11 is a cross-sectional view illustrating a final-stage rotor blade of a gas turbine according to the fifth embodiment of the present invention.
Figure 12:
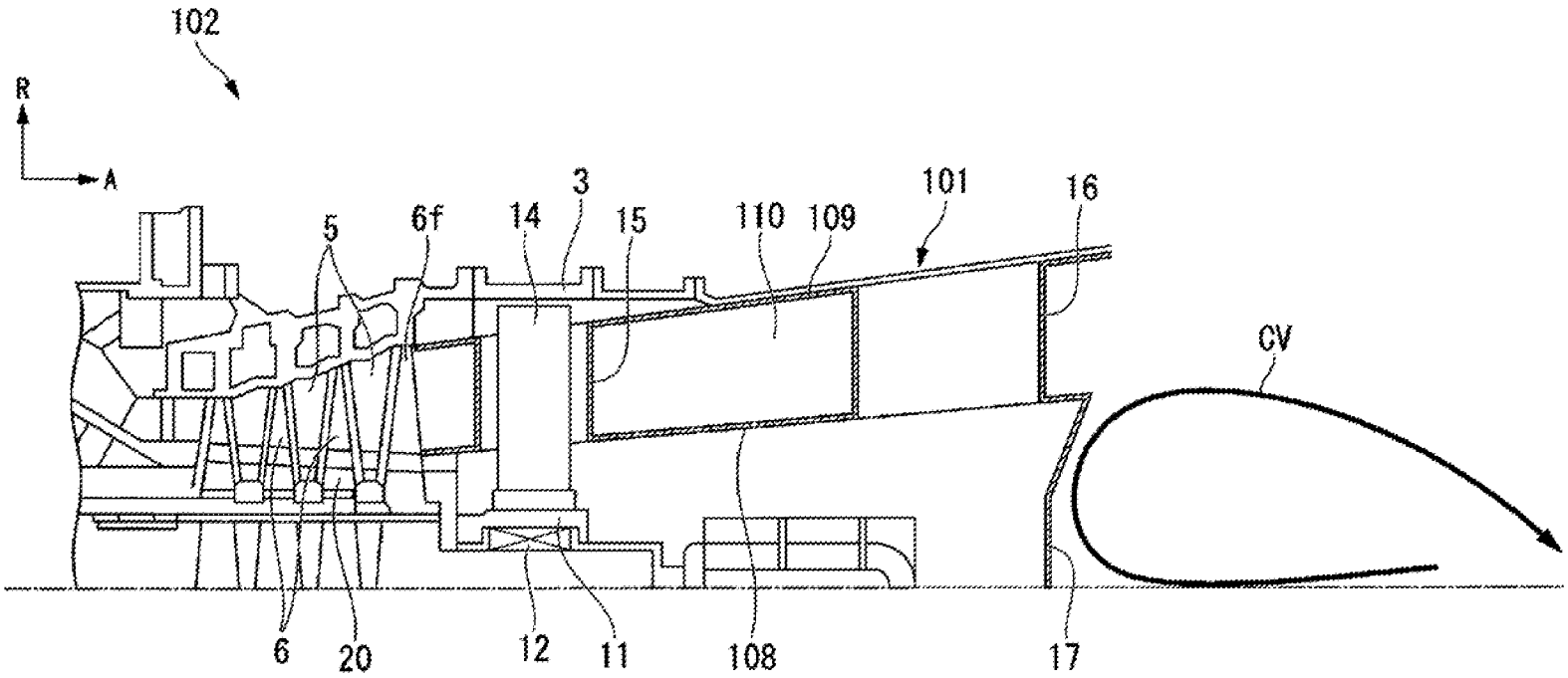
FIG. 12 PRIOR ART
FIG. 12 is a cross-sectional view illustrating a section around an exhaust diffuser of a conventional gas turbine.

As illustrated in FIG. 11, the final-stage rotor blade 6 of the present embodiment is formed so that the total pressure of the working fluid at an outlet of the final-stage rotor blade 6 on the base end side (hub side) of the final-stage rotor blade 6 becomes high compared with the total pressure in a central section of the flow path in the blade-height direction of the final-stage rotor blade 6. As a result, the flow rate on the base end side of the final-stage rotor blade 6 becomes fast, and thereby, the risk of separation becomes small. Thus, it is possible to decrease the diameter over the entire section of the inner-circumferential inner wall.

According to the above-described embodiment, as a result of causing the inner-circumferential inner wall 8E to have a shape in which the diameter thereof decreases over the entire section of the inner-circumferential inner wall 8E in the axial direction, it is possible to make an angle of the inner-circumferential inner wall 8E gentle, and thus, to further inhibit the separation of the fluid.

Note that the shape of the diffuser of the present embodiment can be applied not only to the turbine, but also to a diffuser connected to a compressor on the downstream side of the compressor.

Note that the technical scope of the present invention is not limited to the above-described embodiments, and various changes can be made without departing from the scope of the present invention. For example, although, in each of the above-described embodiments, a structure has been illustrated in which the circular flow path 10 is provided with the strut 14 and the manhole 16, a second strut and a second strut cover may be provided instead of the manhole 16. In this case, even when a long and large exhaust diffuser is formed, it is possible to secure the strength of the exhaust diffuser.

Furthermore, a structure may be employed in which two or more struts and manholes are provided.

INDUSTRIAL APPLICABILITY

According to the axial flow rotating machine, as the decrease of the diameter of the inner-circumferential inner wall starts from the upstream side of the inlet of the diffuser, it is possible to attain a smooth diffuser effect from the upstream side of the inlet. Furthermore, it is possible to form all or a portion of the inner-circumferential inner wall of the diffuser with a gentle inclination, and thus, it is possible to reduce the separation of the flow.

REFERENCE SIGNS LIST

1 Exhaust diffuser
2 Gas turbine
3 Turbine casing
5 Stator blade
6 Rotor blade
6*f* Final-stage rotor blade
7 Final blade
8 Diffuser inner-circumferential inner wall
8B, 8C, 8D, 8E Inner-circumferential inner wall
9 Outer-circumferential inner wall
10 Circular flow path
11 Bearing housing
12 Bearing
14 Strut
15 Strut cover
15*a* Leading edge
15*b* Trailing edge
16 Manhole
16*a* Leading edge
16*b* Trailing edge
17 Base surface
18 Connecting member inner-circumferential inner wall
20 Rotor
20*a* Final blade portion inner-circumferential inner wall
21 Stator
22 Axial flow rotating portion
A Flow direction
B1, B2 Center axis
R Radial direction
R1, R2, R3 Range
S1 First inclination portion
S2 Second inclination portion
T1 Throat position
T2 Throat position

The invention claimed is:

1. A diffuser configured to be connected to a final-stage rotor blade of a turbine on a downstream side of the final-stage rotor blade, the diffuser comprising:

an outer-circumferential inner wall;

an inner-circumferential inner wall; and a strut cover, wherein:

the outer-circumferential inner wall is positioned on an outer circumferential side of the inner-circumferential inner wall such that the outer-circumferential inner wall is separated from the inner-circumferential inner wall and a circular flow path is defined between the outer-circumferential inner wall and the inner-circumferential inner wall;

the strut cover connects the inner-circumferential inner wall and the outer-circumferential inner wall in a radial direction inside the circular flow path;

the inner-circumferential inner wall includes a first inclination portion and a second inclination portion downstream of the first inclination portion;

the first inclination portion is a straight linear portion inclined at a first inclination angle in a cross section of the diffuser along an axial direction;

the second inclination portion is a straight linear portion inclined at a second inclination angle in the cross section of the diffuser along the axial direction;

the first inclination angle is different from the second inclination angle;

a diameter of the inner-circumferential inner wall along the second inclination portion decreases in a direction of a downstream side in the axial direction; and an end of the first inclination portion is between a leading edge position of the strut cover and a trailing edge position of the strut cover in the axial direction.

2. The diffuser according to claim 1, wherein the first inclination portion and the second inclination portion are connected at a position between the leading edge position of the strut cover and the trailing edge position of the strut cover in the axial direction.

3. The diffuser according to claim 2, wherein the position between the leading edge position of the strut cover and the trailing edge position of the strut cover in the axial direction is a position between a throat position and the trailing edge position of the strut cover in the axial direction.

4. The diffuser according to claim 2, wherein:

the second inclination angle is equal to or greater than the first inclination angle; and the second inclination angle is less than 0 degrees.

5. The diffuser according to claim 1, wherein:

the second inclination angle is equal to or greater than the first inclination angle; and the second inclination angle is less than 0 degrees.

6. The diffuser according to claim 1, wherein:

the diameter of the inner-circumferential inner wall along the second inclination portion is a second diameter; and a first diameter of the inner-circumferential inner wall along the first inclination portion increases in the direction of the downstream side in the axial direction.

7. The diffuser according to claim 1, wherein a cross section of the strut cover is blade-shaped.

8. A diffuser configured to be connected to a final-stage rotor blade of a turbine on a downstream side of the final-stage rotor blade, the diffuser comprising:

an outer-circumferential inner wall;

an inner-circumferential inner wall; and a strut cover, wherein:

the outer-circumferential inner wall is positioned on an outer circumferential side of the inner-circumferential inner wall such that the outer-circumferential inner wall is separated from the inner-circumferential inner wall and a circular flow path is defined between the outer-circumferential inner wall and the inner-circumferential inner wall;

the strut cover connects the inner-circumferential inner wall and the outer-circumferential inner wall in a radial direction inside the circular flow path;

the inner-circumferential inner wall includes a first portion and a second portion downstream of the first portion;

the first portion is a straight linear portion disposed at a first angle in a cross section of the diffuser along an axial direction;

the second portion is a straight linear portion disposed at a second angle in the cross section of the diffuser along the axial direction;

the first angle is different from the second angle;

a diameter of the inner-circumferential inner wall along the first portion decreases in a direction of a downstream side in the axial direction; and the first portion and the second portion are connected at a position between a leading edge position of the strut cover and a trailing edge position of the strut cover in the axial direction.

* * * * *